US006861119B2

(12) United States Patent
Bergström et al.

(10) Patent No.: US 6,861,119 B2
(45) Date of Patent: Mar. 1, 2005

(54) PRESSURE-LOADED PANEL AND USE FOR BOAT AND CONTAINER CONSTRUCTION

(75) Inventors: Rainer Bergström, Mikkeli (FI); Jari Viljakainen, Mikkeli (FI)

(73) Assignee: Ahlstrom Glassfibre Oy, Karhula (FI)

( * ) Notice: Subject to any disclaimer, the term of this patent is extended or adjusted under 35 U.S.C. 154(b) by 0 days.

(21) Appl. No.: 10/687,869

(22) Filed: Oct. 20, 2003

(65) Prior Publication Data

US 2004/0102121 A1 May 27, 2004

Related U.S. Application Data

(62) Division of application No. 09/508,463, filed as application No. PCT/FI98/00737 on Mar. 10, 2000, now abandoned.

(30) Foreign Application Priority Data

Sep. 18, 1997 (FI) ..... 973721

(51) Int. Cl.[7] ..... B32B 5/12

(52) U.S. Cl. ..... 428/113; 428/102; 428/105; 428/911; 442/366; 442/367

(58) Field of Search ..... 442/366, 367; 428/102, 105, 113, 911

(56) References Cited

U.S. PATENT DOCUMENTS

| | | | | |
|---|---|---|---|---|
| 2,836,529 A | | 5/1958 | Morris | |
| 3,812,553 A | | 5/1974 | Marshall et al. | |
| 4,265,961 A | | 5/1981 | Bena | |
| 4,819,395 A | | 4/1989 | Sugita et al. | |
| 5,198,280 A | * | 3/1993 | Harpell et al. | 428/102 |

FOREIGN PATENT DOCUMENTS

| | | |
|---|---|---|
| CH | 470 552 | 5/1969 |
| EP | 0 073 648 | 3/1983 |
| EP | 0 719 635 A2 | 7/1996 |
| FI | 52477 | 5/1977 |
| FI | 864829 | 5/1987 |
| FI | 864829 | 9/1991 |
| GB | 1 364 076 | 8/1974 |
| GB | 2 253 811 A | 9/1992 |
| SE | 315 093 | 9/1969 |
| WO | WO 97/37835 | 10/1997 |

OTHER PUBLICATIONS

Markku Hentinen et al, Tasaisesti kuormitetun lujitemuovilaatan geometrinen epälineaarisuus, Tutkimuksia Forskningsrapporter 694 Research Reports, Technical Research Center of Finland, Espoo (1990) Abstract p. 4, no month.

Martin Hildebrand et al, "Lujia laminaatteja tuotantoveneisiin", Tutkimuksia Forskningsrapporter 694 Research Reports, Technical Research Centre of Finland, Espoo (1991) Abstract pp. 5 and 6, no month.

* cited by examiner

*Primary Examiner*—Arti R. Singh
*Assistant Examiner*—Andrew T Piziali
(74) *Attorney, Agent, or Firm*—Nixon & Vanderhye, P.C.

(57) ABSTRACT

A substantially laterally pressure-loaded panel has a side aspect ratio of at least 1.5, is formed of at least two reinforcement layers of substantially unidirectional fibers. The predominant orientation of the fibers form an angle of between about ±55°–±75° (preferably about 60°) with the longer side of the panel, with about one-half of the layers having a positive (+) angle and about one-half a negative (–) angle, within the range. The panel preferably has about 60–100% of its thickness formed by the reinforcement layers. The panels can be used can be used in boat and/or shipbuilding structural panels, pressure-loaded tanks, pressure-vessels and other corresponding structures that are subjected to a lateral pressure load.

15 Claims, 3 Drawing Sheets

PRESSURE-LOADED PANEL AND USE FOR BOAT AND CONTAINER CONSTRUCTION

CROSS REFERENCE TO RELATED APPLICATION

This application is a U.S. national phase of PCT application No. PCT/F198/00737, filed Sep. 18, 1998, and a divisional application of U.S. application Ser. No. 09/508, 463, filed Mar. 10, 2000 now abandoned.

BACKGROUND AND SUMMARY OF THE INVENTION

The present invention relates to a substantially laterally pressure-loaded reinforced plastic plate with improved properties, e.g. a rectangular or trapezoidal area defined by stiffeners in the hull of a boat, a panel, the side aspect ratio of which, i.e. the relation of the longer sides to the shorter sides, is at least 1.5. In the following, this area is referred to as a panel, irrespective of whether it is positioned in the hull of a boat or used in some other embodiment as a laterally pressure-loaded reinforced plastic plate.

Traditional woven reinforcements are composed of threads that are positioned at an angle of 0° and 90° with respect to each other and bound to each other and interlace according to the desired weaving pattern.

On the market there are new kinds of stitched reinforcement products, i.e. so-called multi-axial reinforcements that may be biaxial, triaxial and quadriaxial with fibre orientations in two, three or four directions in relation to each other respectively. They differ from traditional woven reinforcements at least so that the reinforcement threads form straight unidirectional fibre layers which do not cross the threads of another direction and which layers are typically bound to each other with a thin stitching yarn and so that the threads of individual layers are typically either at an angle of ±45 or 0°/90° with respect to the longitudinal axis of the reinforcement. Multi-axial reinforcements of this type are commonly used in boat laminates and consequently, in boat panels.

The purpose of the invention is to create an improved, substantially laterally pressure-loaded reinforced plastic plate, i.e. a panel, with a side aspect ratio at least 1.5. The purpose of our invention is thus to come up with a solution that among other things improves the mechanical properties of a pressure-loaded reinforced plastic plate, i.e. a panel, so that both the deflection and the stress level decrease in comparison with a laminate that is reinforced at an angle of 0°/90° or ±45° with respect to the longer side of the panel.

The characteristic features of a substantially laterally pressure-loaded reinforced plastic plate, i.e. a panel, according to the invention are disclosed in the characterising portions of the appended patent claims.

In connection with this invention, term reinforcement layer is used to refer such layers of a panel that function as active reinforcing elements. For instance, in the surface layers it is possible to use layers that give the optimal properties as regards the desired surface quality, but which layers may have a reinforcing effect that deviates from the optimal effect. For example, chopped strand mat may be used as surface layers of this kind. An individual reinforcing layer is formed of a so-called unidirectional reinforcement layer, i.e. a reinforcement layer of substantially parallel fibres. Individual reinforcing layers can be used to create so-called multi-axial reinforcements, the use of which facilitates and accelerates the assembly of an entire reinforcement structure.

The basic idea of our invention is the realization that the reinforcements (where the threads of individual layers are arranged typically either at an angle of ±45° or 0°/90° with respect to the longitudinal axis of the reinforcement) in the laterally pressure-loaded reinforcement plates i.e. panels used nowadays may be positioned in a new way in the panel, and consequently, the result would be a panel equal in weight as before. This new panel structure would, however, have better mechanical properties than before. What is meant with improved mechanical properties here is that in a lateral state of pressure, the deflection and the stress level of a panel according to the invention decrease in comparison with a panel constructed in some previously known manner. This kind of panel constructed in any known manner is formed of reinforcement layers that are positioned e.g. at an angle of 0°/90° or ±45° in respect of the longer side of the panel. In the following, the term basic laminate is used to refer to a structure of reinforcement layers constructed in this way. The basic laminate structure is used nowadays for example in boat panels.

The idea according to the invention has later been tested with new calculation methods by using contrary to usual practice a non-linear analysis and element method which require an exceptionally great calculation capacity.

According to our inventive idea we started testing new kinds of panel constructions, where different side aspect ratios were selected for the pressure-loaded panel and the angle between fibre layers were changed.

By using the new kind of multi-axial reinforcement it is possible to improve the mechanical properties of a pressure-loaded reinforced plastic plate so that in the state of lateral pressure both the deflection and the stress level decrease in comparison with a panel constructed in some previously known manner. We detected that for a typical boat laminate and a load on a boat, the optimal fibre angle is between 55° and 90° with a great side aspect ratio.

The advantages of the laminate according to the invention are e.g. a reduction in the failure index by 10% in comparison with the failure index of the basic laminate, an increase in stiffness by 5–10% in comparison with the basic laminate, and consequently, a weight saving of approx. 10% in the final product, i.e. the boat hull laminate, if its mechanical properties are to be kept unchanged. The failure index illustrates the measurement of stress level in each layer. If the failure index is below 1, the stress levels in a layer are below the highest allowed level. The first failure occurs when the failure index reaches the value of 1.

BRIEF DESCRIPTION OF THE DRAWINGS

In the following, the laterally pressure-loaded reinforced plastic plate according to the invention is described in detail by referring to the enclosed figures of which

DETAILED DESCRIPTION

Figure 1:
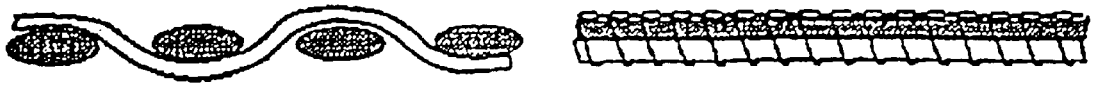
FIG. 1 shows schematically a traditional woven roving and a multi-axial reinforcement (of which a biaxial version is disclosed in the figure)
Figure 2:
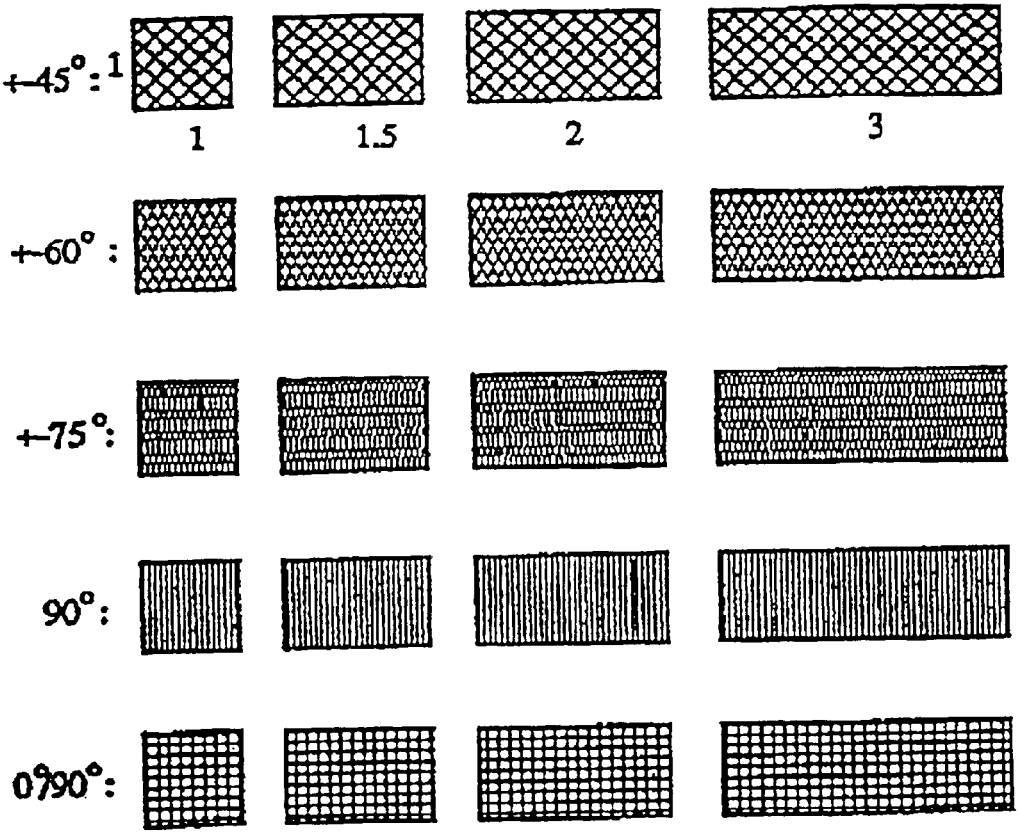
FIG. 2 illustrates the plates used in the study and particularly, the fibre angles and side aspect ratios thereof.

The research that was initiated based on this invention concentrated on studying by calculating both the effect of fibre orientation and the side aspect ratio of the plate used in the study on the deflection and the stresses of the laminate. The element method was used to calculate the behaviour of the panel with various side aspect ratios and various orientations of reinforcement fibres with respect to the long side of the panel. A typical boat laminate that contains partly multi-axial woven reinforcement material and chopped strand mat of E-glass in the surfaces was chosen as an example in the study. In calculations, e.g. E-glass was used as multi-axial reinforcement material. Also other materials may be used either as the only material or a partial material in the multi-axial reinforcement or in individual unidirectional reinforcement layers.

Said laminate is symmetrical in relation to the centre plane. The first and the last layers consist of chopped strand mat (300 g/m$^2$) and in between, there are four layers of multi-axial woven reinforcement (920 g/m$^2$). The following stiffness values and strength values were used in the study:

TABLE 1

The stiffness and strength values of different layers. Subindex "1" stands for "in the direction of the fibres" and subindex "2" for "perpendicularly to the fibre orientation".

| Chopped strand mat 300: | | | A half a layer of fabric 920: | | |
|---|---|---|---|---|---|
| fibre content | [Vol.- %] | 20 | fibre content | [Vol.- %] | 40 |
| fibre content | [mass- %] | 35 | | | |
| E | [GPa] | 9.7 | fibre Content | [mass- %] | 59 |
| G | [GPa] | 3.6 | | | |
| v | [—] | 0.325 | $E_1$ | [GPa] | 28.0 |
| t | [mm] | 0.6 | $E_2$ | [GPa] | 8.4 |
| $\sigma_{tensile}$ | [MPa] | 120 | $G_{12}$ | [GPa] | 5.2 |
| $\sigma_{compressive}$ | [MPa] | 150 | $\upsilon_{12}$ | [—] | 0.06 |
| $\tau$ | [MPa] | 70 | $\upsilon_{21}$ | [—] | 0.2 |
| | | | t | [mm] | 0.45 |
| | | | $\sigma$1-tensile | [MPa] | 480 |
| | | | $\sigma$1-compressive | [MPa] | 400 |
| | | | $\sigma$2-tensile | [MPa] | 40 |
| | | | $\sigma$2-compressive | [MPa] | 140 |
| | | | $\tau_{12}$ | [MPa] | 35 |

In the study the length of the short side of the panel was always 0.5 m. The 0°/90° laminate was analysed for the sake of comparison. It represents the fibre orientations of the traditional woven roving.

According to the study, thin pressure-loaded reinforced plastic plates behave non-linearly, i.e. with a high pressure load the deflection does not increase linearly with the load. In order to achieve reliable results this feature has to be taken into account by performing a non-linear analysis.

The non-linear static analysis of this study was performed by using NASTRAN 66 finite element program and a non-linear solver giving a suitable material model for reinforced plastic structures. The calculations were run on a CRAY X-MP super computer.

The boundary conditions and material values used in all plates were identical. All the edges were supported by joint structures so that all rotations were free and displacements fixed. The panels were loaded with a uniform pressure of 30 kPa. In practice, this value corresponds to wave slamming load in a small boat.

In the results the greatest deflection in the panel and the greatest failure index of the laminate were studied (according to the Tsai-Wu theory). The failure index illustrates the measurement of the stress level in each layer. If the failure index is below 1, the stress levels in a layer are smaller than the allowed level. The first failure occurs when the failure index reaches the value of 1.

The results are presented in FIGS. 3–6.

Figure 3:
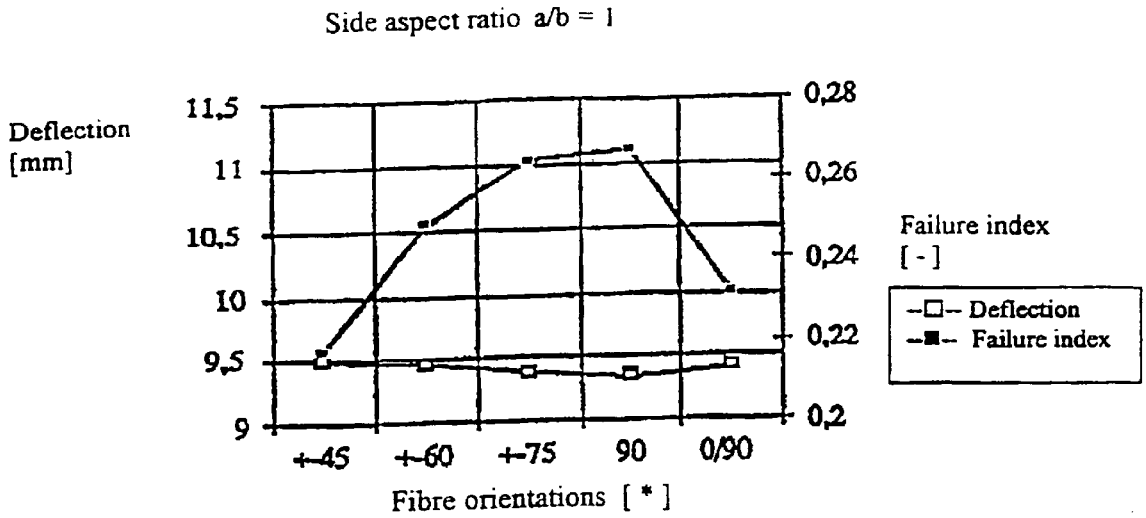
FIGS. 3–6 illustrate the deflection of the pressure-loaded reinforced plastic plates and the greatest failure index in the laminate with side aspect ratios of 1.0, 1.5, 2.0 and 3.0.

FIG. 3 shows that with the side aspect ratio of 1, the effect of fibre orientations on the deflection is fairly small. With respect to the failure index, the fibre orientations of 45° are the most preferable.

Figure 4:
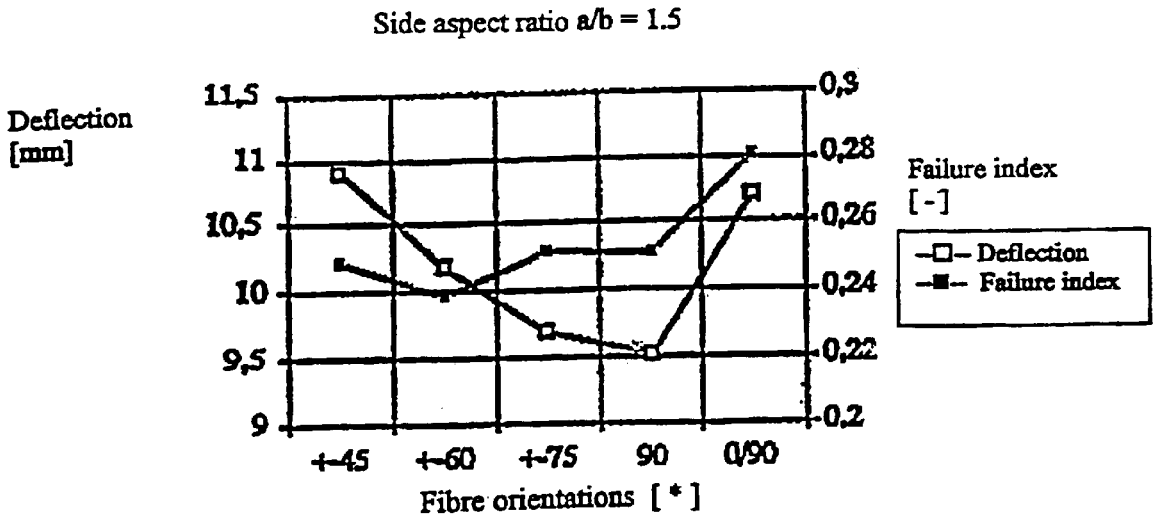
Figure 5:
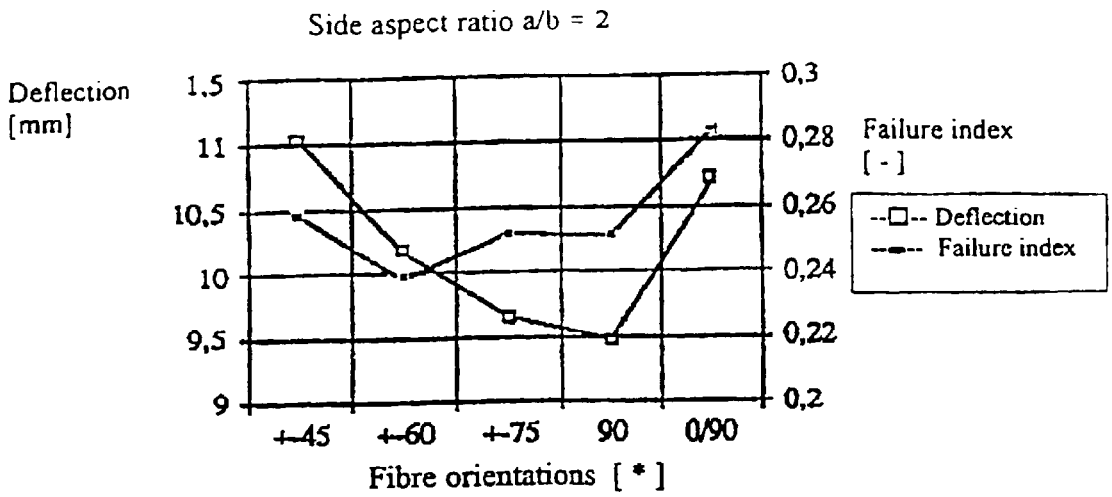
Figure 6:
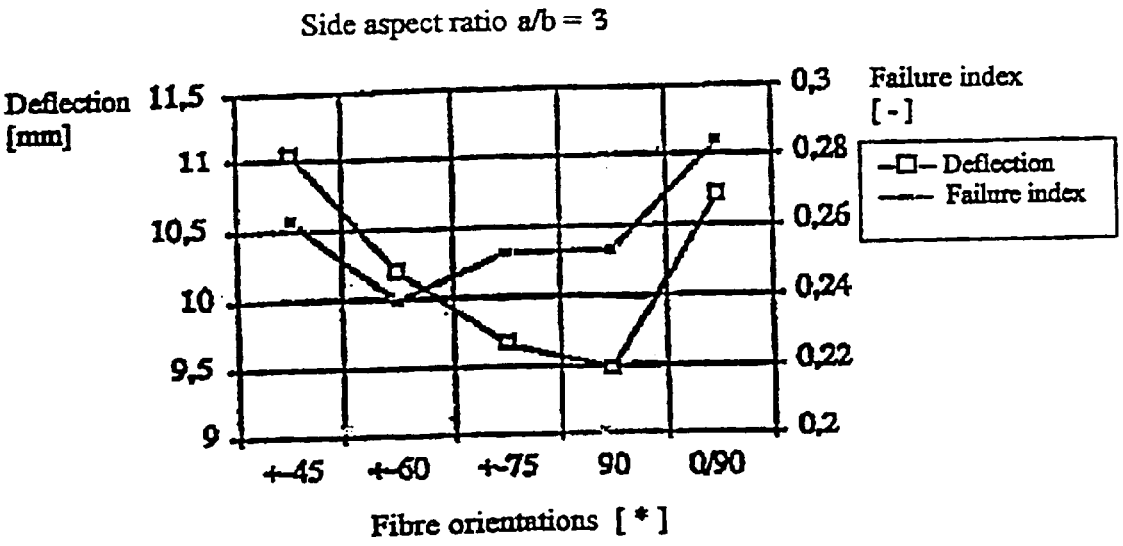

FIGS. 4 to 6 show that the behaviour of the panel is practically identical with side aspect ratios greater than 1.5. The smallest value of deflection is reached with the fibre orientation of 90°. The failure index is smallest with the fibre orientations of ±60°. In practice it can be noticed that the fibre orientations of ±55°–±75° are applicable, preferably ±58°–±65°, even though according to the figures, the best result is reached with the fibre orientation of ±60°.

Deflection of the Plate:

The optimal fibre angle with a great side aspect ratio is between 75° and 90°. In comparison with the 0°/90° and ±45° laminate, the differences in deflection are in the range of 10% with a great range of side aspect ratio. The differences are small with the side aspect ratio of 1.

Failure Index:

In all examples the failure index is greatest in the second layer, i.e. in the first reinforcement layer in the inside of the panel (on the side of the tension). The optimal fibre angle is between 60°–90°, except with the side aspect ratio of 1 when it is 45°. Compared with the 0°/90°-laminate, the failure index decreases approximately by 15%.

The invention relates to a substantially laterally pressure-loaded panel, the side aspect ratio of which being at least 1.5 and which panel being comprised at least of two reinforcement layers of substantially parallel fibres, i.e. unidirectional reinforcement layers, the predominant orientations of which form an angle with respect to the sides of the panel. Good results have been achieved, when the angle between the predominant fibre orientation of the unidirectional reinforcement layer and the longer side of the panel is approx. ±55°–±75°, preferably approx. ±58°–±65°, more preferably approx. ±60°, and when approximately one half of the unidirectional reinforcement layers used in the thickness of the panel forms a desired—-angle with the longer side of the panel and correspondingly, approximately the other half forms a desired —-angle with the longer side of the panel.

In an embodiment of the invention, a substantial part of the thickness of the panel and preferably 60–100%, more preferably more than 70% of the thickness of the panel, is composed of reinforcement layers that are formed of substantially parallel fibres, i.e. unidirectional reinforcement layers, the predominant orientations of said reinforcement layers forming with the longer side of the panel an angle of approx. ±55°–75° and preferably approx. ±58°–65°, more preferably approx. ±60°. Further, approximately one half of the unidirectional reinforcement layers used in the thickness of the panel forms a desired+-angle with the longer side of the panel and correspondingly, approximately the other half forms a desired–-angle with the longer side of the panel.

In another embodiment of the invention at least two of the reinforcement layers of the panel are attached to each other by means of stitching, whereby these layers form a multi-axial reinforcement.

In an embodiment of the invention a substantial part of the thickness of the panel and preferably 60–100% and more preferably more than 70% of the thickness of the panel is composed of reinforcement layers of multi-axial reinforcements.

Pressure-loaded panels in accordance with the invention are preferably manufactured substantially of fibres of E-glass. Also other reinforcement fibre materials can be used as a partial material or as the only material in different reinforcement layers in the panel or in multi-axial reinforcements.

Panels in accordance with the invention can preferably be used in boat and/or shipbuilding and also in other pressure-loaded tanks, pressure vessels and other corresponding structures that are subjected to a lateral pressure load.

What is claimed is:

1. A vessel wall comprising:

a laterally pressure-loaded reinforced rigid plastic panel;

said panel being delimited by stiffeners of said wall;

wherein said panel has a longer side and a shorter side, wherein said longer side is at least 1.5 times a length of said shorter side, and said rigid panel having a plurality of reinforcing laminated layers bonded together of substantially unidirectional substantially parallel fibers having a predominant orientation that form an angle with said sides of said panel;

said angle between said predominant orientation and the longer side of said panel being between about 55° to 75° so that approximately one-half of said reinforcing laminated layers of said panel form a positive angle between about 55° to 75°, and approximately one-half of said reinforcing layers forming a negative angle between about 55° to 75° with respect to said longer side of said panel, and wherein said panel is laterally loaded by fluid pressure.

2. A vessel wall as in claim 1 wherein said positive angle is about positive 58° to 65° and said negative angle is about minus 58° to minus 65°.

3. A vessel wall as recited in claim 1 wherein said positive angle is about positive 60° and said negative angle is about minus 60°.

4. A vessel wall as recited in claim 1 wherein said reinforcing laminated layers comprise at least 60% of a thickness of said panel.

5. A vessel wall as recited in claim 1 wherein a first layer of said reinforcing laminated layers comprises fibers having a positive orientation and a second layer of said reinforcing laminated layers comprises fibers having a negative orientation, wherein said first layer is stitched to said second layer.

6. A vessel wall as recited in claim 5 wherein at least 70% of a thickness of said panel is formed by the reinforcing laminated layers stitched together.

7. A vessel wall as recited in claim 1 wherein said fibers are E-glass fibers.

8. A vessel wall as recited in claim 1 wherein said fibers of said panel comprise E-glass fibers.

9. A vessel wall as recited in claim 2 wherein a first layer of said reinforcing laminated layers comprises fibers with a positive orientation and a second layer of said reinforcing laminated layers comprises fibers a negative orientation, where said first layer is stitched to said second layer.

10. A panel as recited in claim 3 wherein a first layer of said reinforcing laminated layers comprises fibers with a positive orientation and a second layer of said reinforcing laminated layers comprises fibers a negative orientation, where said first layer is stitched to said second layer.

11. A vessel wall as recited in claim 10 wherein at least 70% of a thickness of said panel is formed by said layers, wherein said layers are stitched together.

12. A vessel wall as recited in claim 9 wherein at least 70% of a thickness of said panel, wherein said layers are stitched together.

13. A vessel wall as recited in claim 2 wherein said fibers are E-glass fibers.

14. A vessel wall as recited in claim 3 wherein said vessel is a boat or a ship.

15. A vessel wall of a boat or ship comprising:

a laterally pressure-loaded reinforced rigid plastic panel;

said plate supported by stiffeners of a vessel having said wall;

wherein said panel has a longer side and a shorter side, wherein said longer side is at least 1.5 times a length of said shorter side, and said rigid panel having a plurality of reinforcing laminated layers bonded together of substantially unidirectional fibers, wherein said fibers in each layer have a predominant orientation forming an angle with said longer side of said panel of about 55° to 75°, and approximately one-half of said reinforcing layers of said panel forming a positive angle between about 55° to 75°, and approximately one-half of said reinforcing layers forming a negative angle between about 55° to 75°, wherein said panel, when mounted in said vessel wall, is laterally loaded by fluid pressure.

* * * * *